US005297918A

United States Patent [19]

Ding

[11] Patent Number: 5,297,918

[45] Date of Patent: Mar. 29, 1994

[54] AUTOMATIC PARKING DEVICE FOR A MULTI-DECK PARKING LOT

[76] Inventor: Liu S. Ding, No. 8, Lane 175, Sec. 1, Kang Ning Rd., Ne Hu Dist., Taipei, Taiwan

[21] Appl. No.: 864,777

[22] Filed: Apr. 7, 1992

[51] Int. Cl.[5] ..... E04H 6/00

[52] U.S. Cl. ..... 414/240; 414/232; 414/259

[58] Field of Search ..... 414/227, 232, 233, 234, 414/235, 236, 239, 240, 241, 243, 253, 259, 260

[56] References Cited

U.S. PATENT DOCUMENTS

| | | | |
|---|---|---|---|
| 2,864,515 | 12/1958 | Marshall | 414/236 X |
| 3,040,913 | 6/1962 | Foster, Jr. et al. | 414/236 |
| 3,061,120 | 10/1962 | Barnett | 414/240 |
| 3,217,905 | 11/1965 | Frangos | 414/239 |
| 3,680,718 | 8/1972 | Miyachi | 414/239 |
| 4,306,985 | 12/1981 | Desprez et al. | 414/234 X |
| 4,825,927 | 5/1989 | Woodrow | 414/232 X |
| 4,874,280 | 10/1989 | Gamberini | 414/234 |
| 5,018,926 | 5/1991 | Sternad | 414/240 X |
| 5,190,427 | 3/1993 | Lai | 414/239 X |

*Primary Examiner*—Frank E. Werner
*Assistant Examiner*—James T. Eller, Jr.
*Attorney, Agent, or Firm*—Lowe, Price, LeBlanc & Becker

[57] ABSTRACT

An automatic parking device for a multi-deck parking lot for motor vehicles is described. The device includes a carrier to carry a moveable platform from a parking position to a base or from a base to the parking position, and a hydraulic cylinder to move the moveable platform from the carrier to a fixed platform at an exit or from the fixed platform to the carrier. An inductor is provided on a moveable rod, which is driven by the hydraulic cylinder to move the moveable platform between the carrier and the platform and to automatically control an electromagnetic switch which drives two retaining iron strips to lock the moveable platform in the carrier.

1 Claim, 5 Drawing Sheets

AUTOMATIC PARKING DEVICE FOR A MULTI-DECK PARKING LOT

BACKGROUND OF THE INVENTION

The present invention relates to an automatic parking device for parking motor vehicles in a multi-deck parking lot automatically.

In a multi-deck parking lot for motor vehicles, the motor vehicle to be parked must be driven by the driver onto a parking platform on a locating place inside the multi-deck parking lot before the driver exits the motor vehicle, which parking platform is further moved by a mechanical mechanism to the assigned parking position. When taking the motor vehicle from the parking lot, the driver must go to the loading place inside the parking lot to take the motor vehicle from the platform which was moved thereto by the mechanical mechanism.

The present invention has been accomplished to provide an automatic parking device for a multi-deck parking lot which utilizes a carrier to carry a movable platform to a base and moved by a hydraulic cylinder to a fixed platform at an exit for loading or unloading a motor vehicle. Therefore, the parking device makes parking easy and safe.

DETAILED DESCRIPTION OF THE PREFERRED EMBODIMENT

Figure 1:
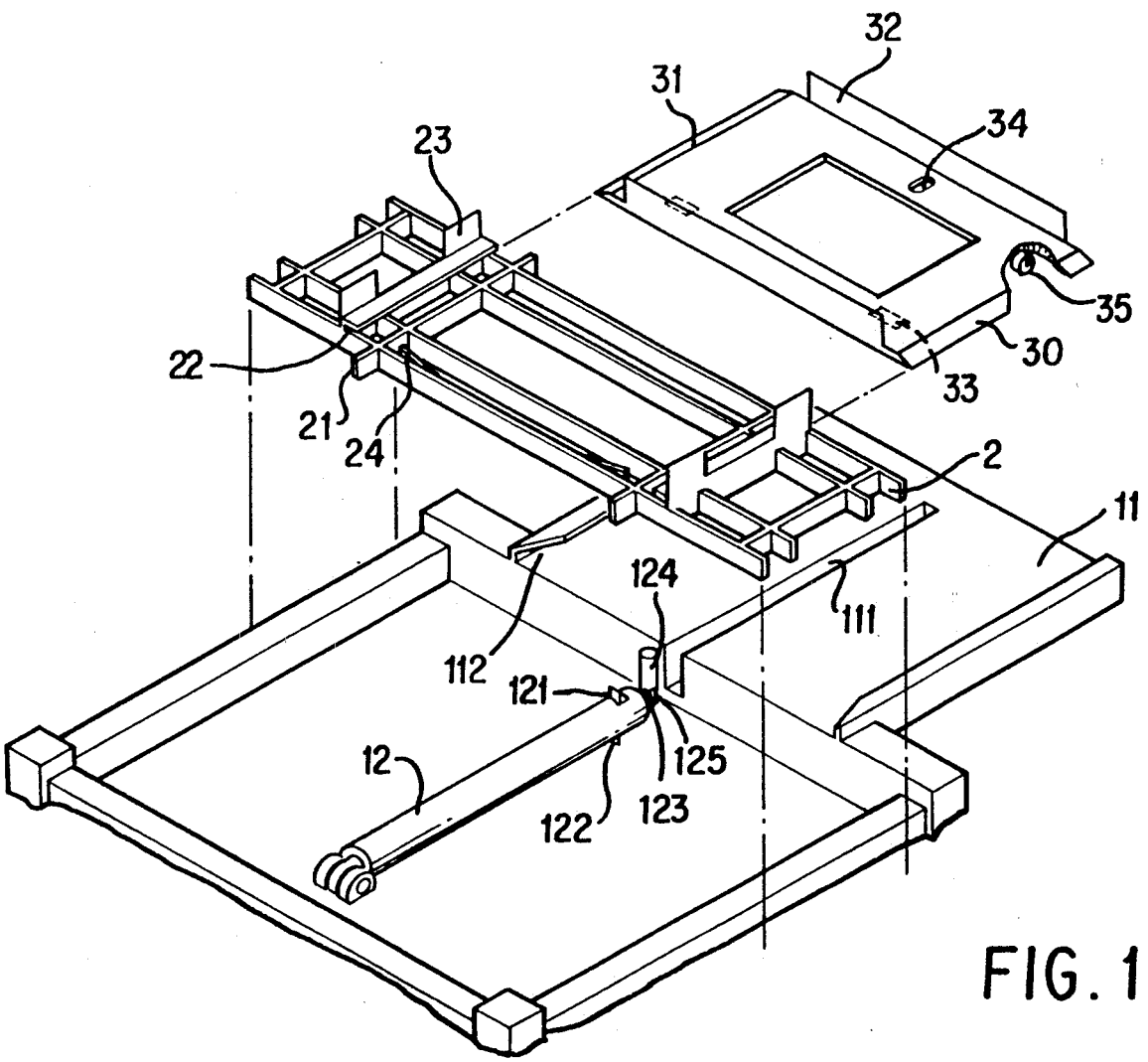
FIG. 1 is a dismantled perspective view of the preferred embodiment of the present invention.
Figure 2:
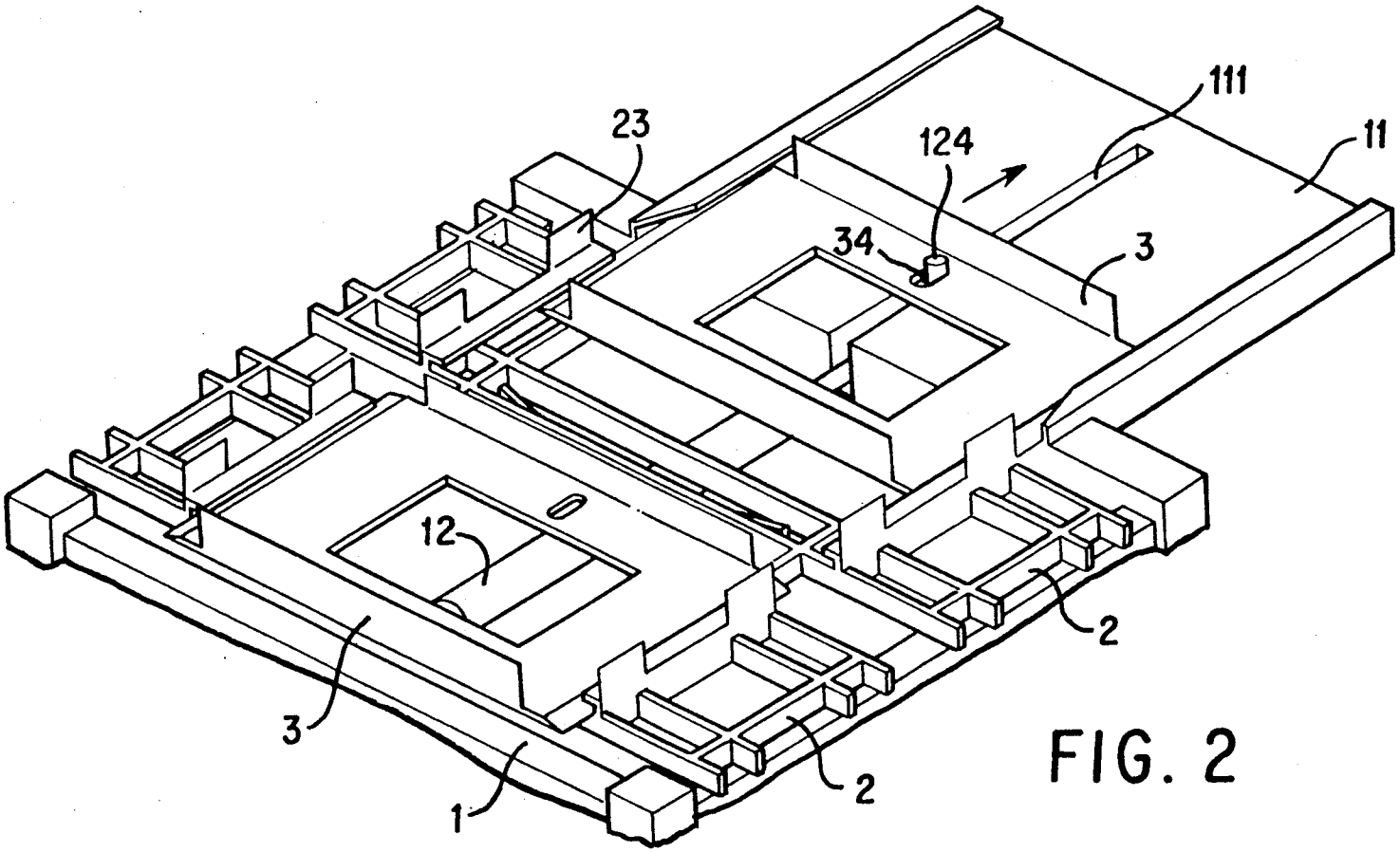
FIG. 2 is a perspective view thereof showing that the movable platform is moved from the carrier to the fixed platform of the base by the hydraulic cylinder.
Figure 3:
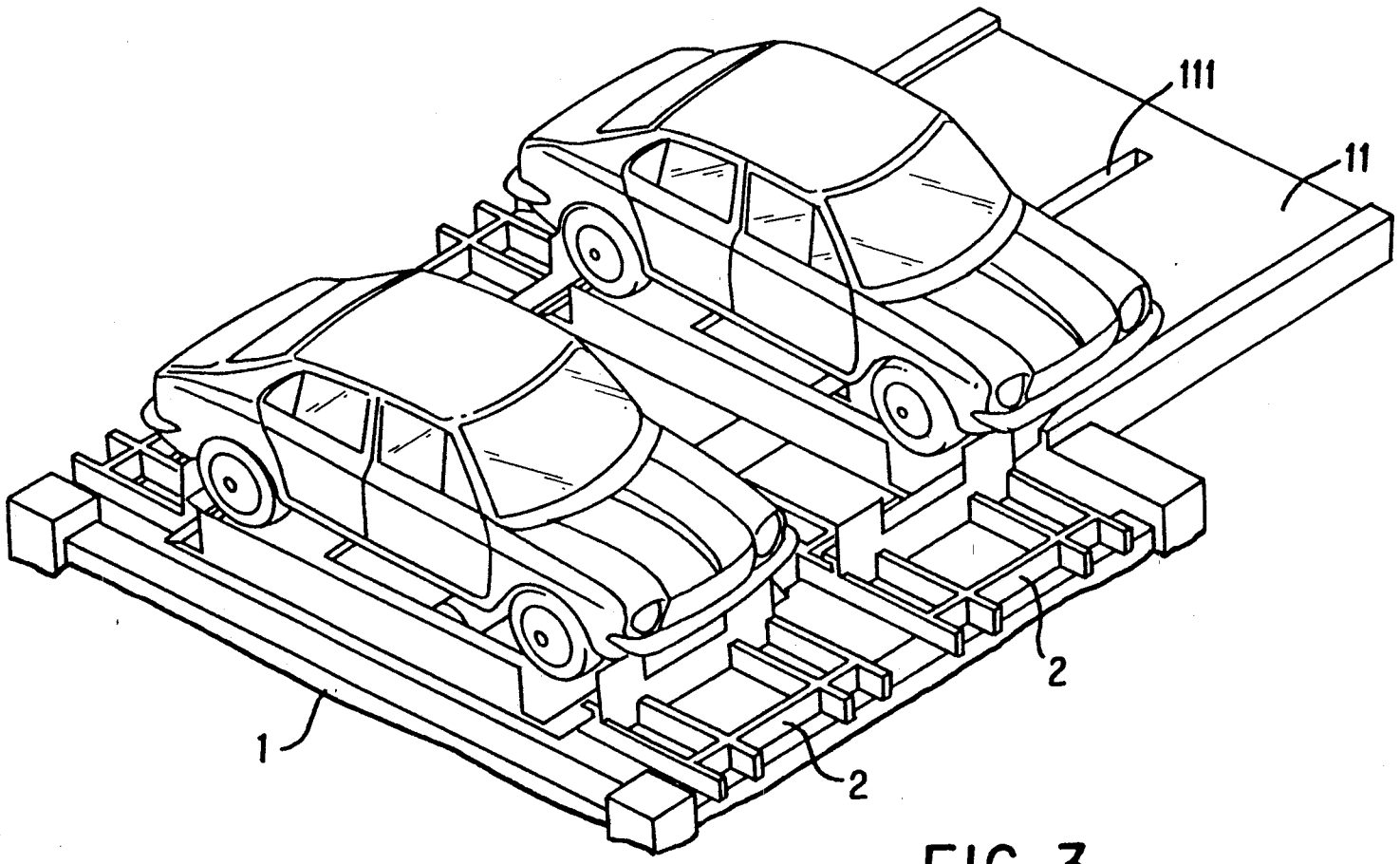
FIG. 3 is a plan view showing that the movable platform is loaded on the carrier to be moved to the fixed platform.
Figure 4:
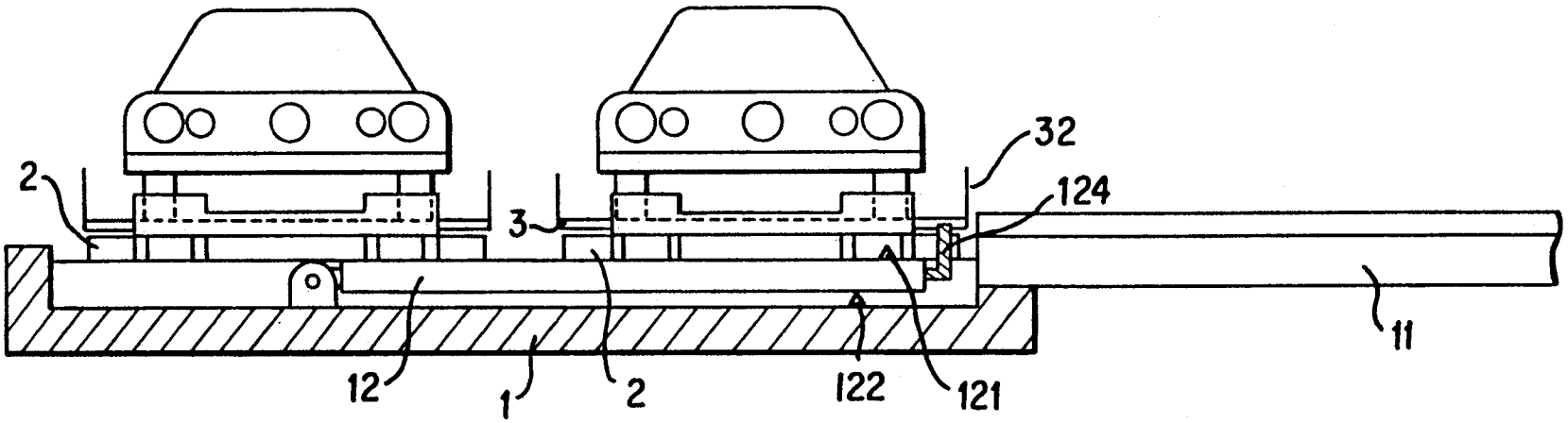
FIG. 4 is another plan view showing that the movable platform has been moved from the carrier to the fixed platform.
Figure 5:
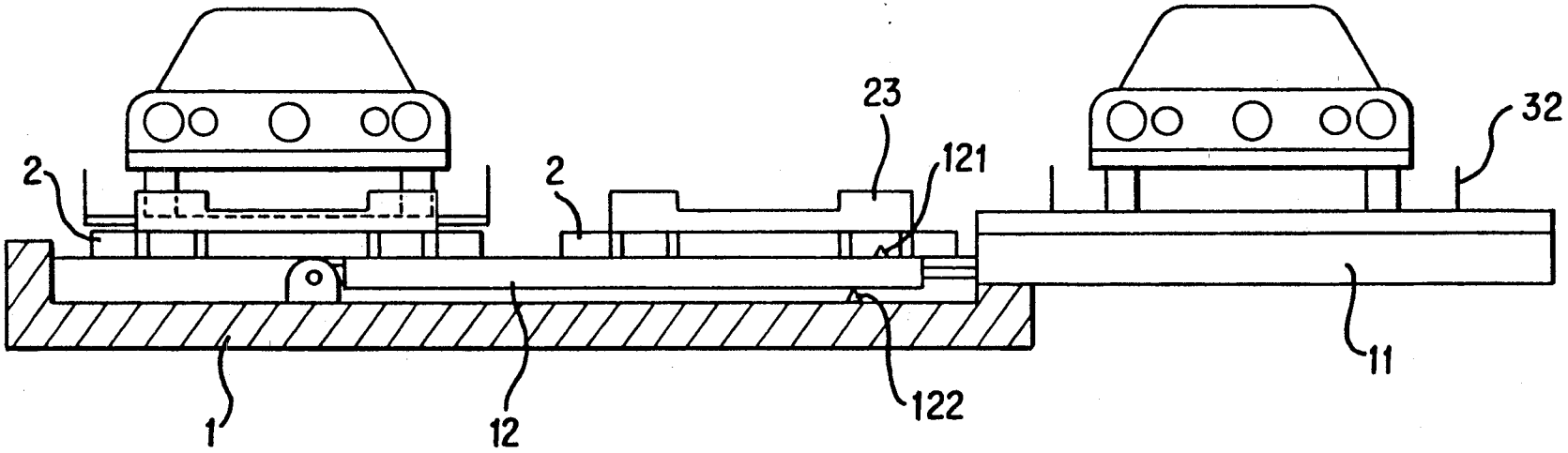
FIG. 5 is another plan view showing that the movable platform has been moved from the carrier to the fixed platform.

Referring to the annexed drawings in detail, therein illustrated is an automatic parking device embodying the present invention which is generally comprised of a base 1, a carrier 2, and a movable platform 3.

The base 1 has a fixed platform 11 horizontally disposed at one side, which fixed platform 11 has an elongated groove 111 at the middle and two sliding ways 112 at two opposite ends, a hydraulic cylinder 12 at the middle spaced from and longitudinally aligned with said elongated groove 111, which hydraulic cylinder 12 has a triangular block 121 at the top adjacent to the front end thereof, a plate spring 122 at the bottom opposite to said triangular block 121. The hydraulic cylinder 12 drives a movable rod 123 to move back and forth alternatively, which movable rod 123 has a hooked front end 124 attached with an inductor 125 at one side.

The carrier 2 is made from crossed channel steels comprising two rails 21 at two opposite ends, two sliding ways 22 at the outer side relative to said two rails 21, two stop plates 23 at the outer side relative to said two sliding ways 22, and two retaining iron strips 24 at the inner side relative to said two rails 21.

The movable platform 3 has two sloping edges 30 and 31 at two opposite ends, two vertical side walls 32 at two opposite sides, two retaining slots 33 at two opposite ends adjacent to one of said vertical side walls, a retaining hole 34 at the middle adjacent to the other vertical side wall, and a plurality of rollers 35 on the bottom at the four corners thereof.

The movable platform 3 is placed on the carrier 2 permitting the retaining iron strips 24 to be respectively engaged in the retaining slots 33. Therefore, the movable platform 3 is firmly retained to the carrier 2. When the movable platform 3 is carried by the carrier 2 and moved from the fixed plate platform 11 to the hydraulic cylinder 12 over the triangular block 121, the hydraulic cylinder 12 is forced downwards. Once the channel steels of the carrier 2 have passed over the triangular block 121, the plate spring 122 automatically forces the hydraulic cylinder 12 to move back to its original position, causing the hooked front end 124 of the movable rod 123 thereof to hook in the retaining hole 34 on the movable platform 3. If the movable platform 3 is carried by the carrier 2 and directly loaded on the base 1 from the top, the hooked front end 124 of the movable rod 123 of the hydraulic cylinder 12 directly inserts in the retaining hole 34 on the movable platform 3. Once the hooked front end 124 of the movable rod 123 of the retaining hole 34, the inductor 125 on the hooked front end 124 is induced to turn on an electromagnetic switch (not shown) which drives the retaining iron strips 24 out of the retaining slots 33 and simultaneously triggers the hydraulic cylinder 12 to move the movable rod 123 outwards along the elongated groove 111, and therefore, the two opposite sloping edges 30 and 31 of the movable platform 3 are moved outwards along the two sliding ways 22 on the carrier 2 into the two sliding ways 112 on the fixed platform 11 and the rollers 35 of the movable platform 3 are simultaneously moved along the rails 21 to the fixed platform 11. Once the movable platform 3 is moved to the fixed platform 11, the motor vehicle can then be driven onto or away from the movable platform 3. Once a motor vehicle is loaded onto the movable platform 3 or taken away therefrom, the movable rod 123 is moved backwards to pull the movable platform 3 back to the carrier 2 and, the inductor 125 immediately cuts off the electromagnetic switch causing the retaining iron strips 24 to engage in the retaining slots 33 again, and therefore, the movable platform 3 is retained in the carrier 2. By moving the carrier 2, the movable platform 3 can be carried to the assigned parking position.

What is claimed is:

1. An automatic parking device of a multi-deck parking lot for motor vehicles, comprising:

a base having a fixed platform horizontally disposed at one side and a hydraulic cylinder at a middle portion thereof, said fixed platform having an elongated groove at a middle portion thereof and two sliding ways at two opposite ends thereof, said hydraulic cylinder having a movable rod to move back and forth alternatively and having a triangular block at a top portion adjacent to a front end thereof and a plate spring at a bottom portion opposite said triangular block, said movable rod having a hooked front end aligned with said elongated groove on said fixed platform, said hooked front end having an inductor attached thereto to control an electromagnetic switch;

a carrier made from crossed steel channel members, said carrier comprising two rails at two opposite ends, two sliding ways spaced from and outside of said two rails, two stop plates spaced from and outside of said two sliding ways, and two retaining iron strips spaced from and in between said two rails;

a movable platform for loading motor vehicles thereon, said movable platform having two sloping edges at two opposite ends, two vertical side walls at two opposite sides, two retaining slots at said two opposite ends adjacent to one of said vertical side walls, a retaining hole at the middle adjacent to the other vertical side wall, and a plurality of rollers on a bottom portion at the four corners thereof; and wherein said retaining iron strips are respectively engaged in said retaining slots to firmly secure said movable platform to said carrier when said movable platform is placed thereon; said movable platform is carried by said carrier and is movable from said fixed platform toward said hydraulic cylinder to force the hydraulic cylinder downward and once said carrier has passed over said triangular block, said plate spring automatically forces said hydraulic cylinder to move back to its original position, causing said hooked front end to hook in said retaining hole; said hooked front end of said movable rod is directly inserted in said retaining hole when said movable platform is carried by said carrier and loaded on said base from the top, causing said inductor to trigger said electromagnetic switch to an on position so as to drive said retaining iron strips out of said retaining slots and simultaneously drive said hydraulic cylinder to move said movable platform outwards along said elongated groove for loading or unloading a motor vehicle; said movable rod is moved backwards to pull said movable platform from said fixed platform back to said carrier, causing said inductor to cut off the power supply to said electromagnetic switch so that said retaining iron strips are released from said electromagnetic switch and engaged in said retaining slots to retain said movable platform to said carrier again.

* * * * *